US008074526B2

(12) United States Patent
Garcia Aranda et al.

(10) Patent No.: US 8,074,526 B2
(45) Date of Patent: Dec. 13, 2011

(54) CRANKSHAFT MACHINE TOOL TEST DEVICE

(75) Inventors: Lucia Garcia Aranda, Rueil-malmaison (FR); Nicolas Massue, Issy les Moulineaux (FR); Gilles Yvenat, Montigny-le-bretonneux (FR)

(73) Assignee: Renault S.A.S., Boulogne Billancourt (FR)

( * ) Notice: Subject to any disclaimer, the term of this patent is extended or adjusted under 35 U.S.C. 154(b) by 268 days.

(21) Appl. No.: 12/297,446

(22) PCT Filed: Apr. 20, 2007

(86) PCT No.: PCT/FR2007/051142

§ 371 (c)(1),
(2), (4) Date: Jul. 13, 2009

(87) PCT Pub. No.: WO2007/122348

PCT Pub. Date: Nov. 1, 2007

(65) Prior Publication Data

US 2009/0293638 A1 Dec. 3, 2009

(30) Foreign Application Priority Data

Apr. 21, 2006 (FR) ..... 06 03550

(51) Int. Cl.
*G01L 5/16* (2006.01)

(52) U.S. Cl. ..... 73/862.06; 73/780

(58) Field of Classification Search ..... 73/760, 73/862.06

See application file for complete search history.

(56) References Cited

U.S. PATENT DOCUMENTS

| | | | | |
|---|---|---|---|---|
| 4,189,012 | A * | 2/1980 | Garrett | 175/312 |
| 5,410,817 | A * | 5/1995 | Kish | 33/559 |
| 6,216,756 | B1 * | 4/2001 | Mason | 144/248.5 |
| 6,253,590 | B1 | 7/2001 | Lonero et al. | |
| 6,735,840 | B2 * | 5/2004 | Gibbs | 29/90.01 |
| 7,254,973 | B2 * | 8/2007 | Campian | 72/220 |
| 2002/0020202 | A1 | 2/2002 | Bagusche | |
| 2009/0019717 | A1 * | 1/2009 | Nortmann et al. | 33/778 |
| 2009/0106961 | A1 * | 4/2009 | Tomioka et al. | 29/90.01 |

FOREIGN PATENT DOCUMENTS

| | | | |
|---|---|---|---|
| DE | 3712651 | A * | 6/1988 |
| FR | 2 607 920 | | 6/1988 |
| WO | WO 2005/063438 | A1 | 7/2005 |

* cited by examiner

*Primary Examiner* — Max Noori
(74) *Attorney, Agent, or Firm* — Oblon, Spivak, McClelland, Maier & Neustadt, L.L.P.

(57) ABSTRACT

A device for testing roller burnishing tools for a roller burnishing machine including at least one burnishing roller. The device includes a mechanism to hold and to drive in the roller burnishing machine, which causes the test device to rotate; a roller bearing raceway pressing against the roller, the roller bearing raceway exhibiting symmetry of revolution about the axis of rotation of the device, with a profile including a rounded portion; and a cylindrical rolling bearing raceway bearing against support wheels of the roller burnishing machine.

9 Claims, 2 Drawing Sheets

CRANKSHAFT MACHINE TOOL TEST DEVICE

BACKGROUND

The invention relates to the field of machining by roller burnishing, for example of the cylindrical journals of crankshafts. The invention relates in particular to a device for testing roller burnishing tools.

Roller burnishing machines allow the production of fillets on each side of a cylindrical journal of a crankshaft. Each cylindrical journal of a crankshaft is pressed not only between two rollers but also between two support wheels arranged on the opposite side to the rollers. The axis of rotation of the rollers is inclined with respect to the axis of rotation of the crankshaft, the rollers bearing on each side of the cylindrical journal of a crankshaft. The pressure exerted by the rollers makes it possible to roller burnish fillets on each side of a cylindrical journal of a crankshaft. A bearing wheel exerts a pressure force on the rollers, which are held in place by a cage. The rollers roll both on the crankshaft journal and on the bearing wheel when the crankshaft is rotated. The crankshaft is rotated by the roller burnishing machine, which comprises means for retaining and driving the crankshaft.

The operation of roller burnishing crankshafts is very costly. In order to reduce the cost of the operation, the tools need to be optimized to guarantee or improve the service life of the tools and ensure stable wear on the tools. On the one hand, the wear on the tools must be controlled to guarantee the machining quality and, on the other hand, the service life of the tool is optimized to derive maximum profit from the tool and maintain a minimum roller burnishing quality.

A technical problem concerns the performance of tests on the roller burnishing tools. Specifically, service life tests are necessary to guarantee a more stable and longer service life. Similarly, any modifications made to the roller burnishing tools require at least one validation before these tools are used in a machining line. At the present time, the tests carried out on the roller burnishing tools require that a preliminary validation step be carried out in a production line. The setup of the production line therefore has to be modified, a situation which is detrimental in terms of productivity. Furthermore, conducting tests requires a reconfiguration of the production line, which takes a very long time to implement, all the more so since a number of different tests are often necessary. Moreover, the tests are carried out on crankshafts which are wasted as far as selling them is concerned. The number of wasted crankshafts is all the higher since the crankshafts are degraded much more quickly than the roller burnishing tools and since a number of crankshafts are necessary to test the complete wear of a set of roller burnishing tools. These tests on the roller burnishing tools are therefore doubly detrimental with regard to productivity.

BRIEF SUMMARY

The object of the present invention is to overcome a number of disadvantages of the prior art by creating a test device for the tools for roller burnishing crankshafts whereby the test can be carried out without using a crankshaft, the test being carried out independently of the machining line.

This objective is achieved by virtue of a test device for roller burnishing tools that is intended for a machine for roller burnishing at least one cylindrical journal, the machine comprising at least one roller intended to roll on a region of the cylindrical journal that is to be roller burnished, a bearing wheel exerting a pressure on said roller, and two support wheels intended to support the cylindrical journal on the opposite side to said roller, characterized in that said device comprises at least:

- retaining and drive means in the roller burnishing machine, which moves the test device rotationally about an axis of rotation,
- a rolling track for rollers that is associated with said roller and which comes into contact with said roller, the rolling track for rollers having symmetry of revolution about the axis of rotation of the device, with a profile including a rounded portion,
- a cylindrical rolling track coming into contact with said support wheels of the roller burnishing machine.

According to another particular feature, the associated machine is intended for the roller burnishing of a crankshaft comprising a given number of cylindrical journals, the device comprises a cylindrical rolling track for each pair of support wheels and a rolling track for rollers that is associated with each roller of the machine.

According to another particular feature, the device comprises a main shaft supporting rolling rings for the rollers that each comprise at least one of the rolling tracks for rollers, the main shaft supporting rolling rings for the support wheels that each form a cylindrical rolling track for a pair of support wheels, the rolling rings being rotationally secured to the main shaft.

According to another particular feature, the main shaft comprises a shoulder for positioning a rolling ring which comes up against the shoulder.

According to another particular feature, the rolling rings comprise an axial groove by means of which they can be connected with a key providing reinforced retention in terms of rotation, said key being arranged in a groove in the main shaft.

According to another particular feature, the rolling rings for the rollers are each formed by a bearing wheel which is identical to that or those of the roller burnishing machine.

According to another particular feature, the retaining and drive means in the roller burnishing machine comprise:

- a bore arranged at a first end of the main shaft symmetrically to the axis of rotation of the test device and intended to receive a first drive center,
- a threaded hole arranged at a second end of the main shaft arranged symmetrically about the axis of rotation of the test device and intended to receive a threaded rod of a drive device,
- the drive device comprising, on the side directed away from the threaded rod, a bore which is coaxial with the axis of rotation of the test device and intended to receive a second drive center.

BRIEF DESCRIPTION OF THE DRAWINGS

The invention, its features and its advantages will become more clearly apparent on reading the description given with reference to the figures referenced below.

DETAILED DESCRIPTION

Figure 1:
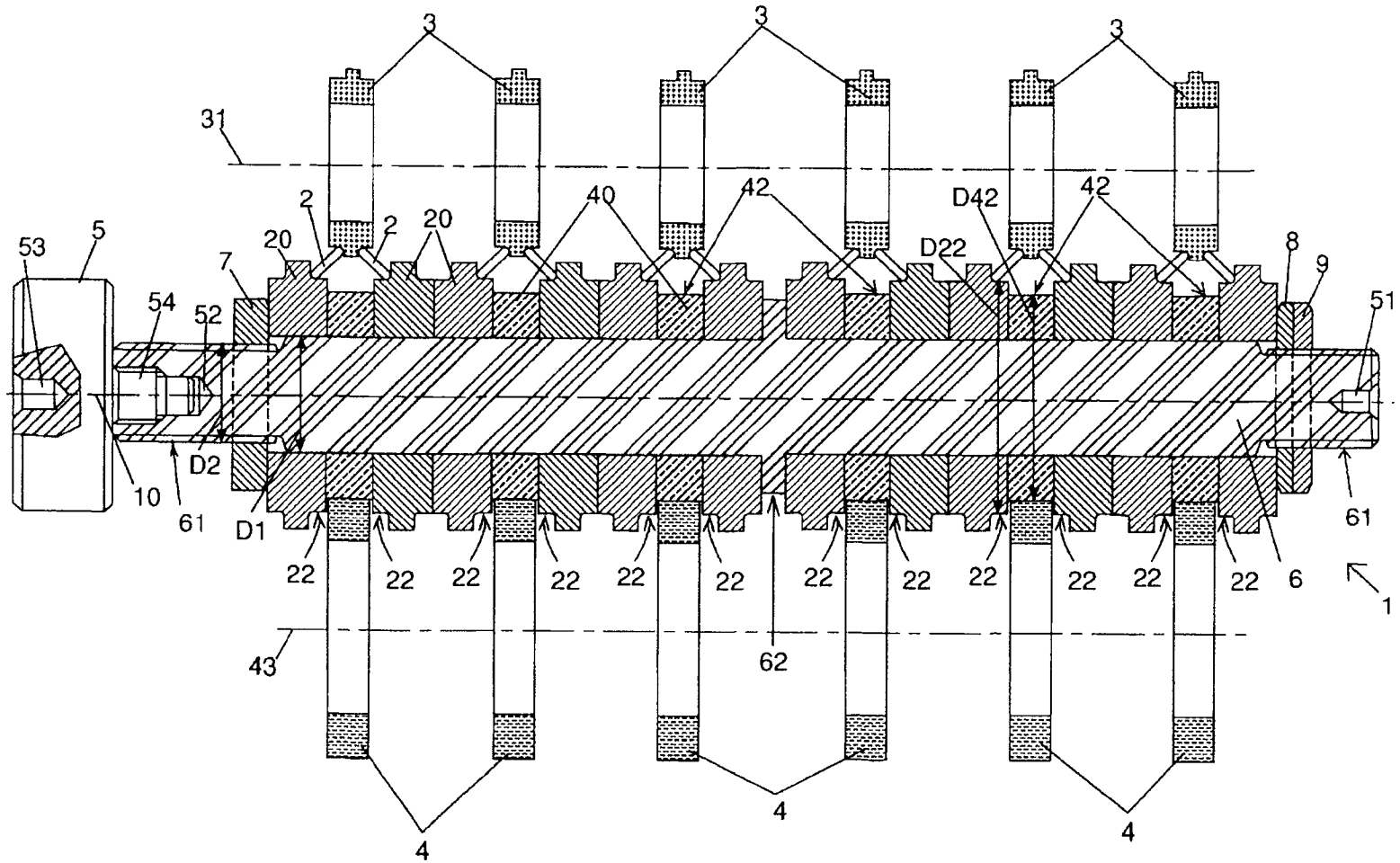
FIG. 1 represents a sectional view of an example of a test device according to the invention on which roller burnishing tools bear.

The invention will now be described with reference to the aforementioned figures. The test device (1) according to the invention is represented in FIG. 1 while bearing on rollers (2) and on support wheels (4). A single support wheel (4) for each cylindrical journal is represented, but roller burnishing machines generally comprise a support casing having two support wheels for each cylindrical journal. The support wheels (4) are coupled rotationally with the roller burnishing machine, about their axis (43). The rollers (2) are held in place by a cage (not shown). Bearing wheels (3) exert a pressure force against the rollers (2). The bearing wheels (3) are rotationally coupled with the roller burnishing machine, about their axis (31). The test device (1) according to the invention is driven to rotate, about its axis (10) of rotation, by the roller burnishing machine, for example using a center/counter-center system. The test device (1) comprises, for example, a housing (51) arranged symmetrically around the axis (10) of rotation, for receiving a support center. On the other hand, a drive device (5) is, for example, screwed by way of a threaded rod (54) into a threaded housing (52) of the test device (1), arranged around its axis (10) of rotation. The drive device (5) receives, for example, a drive center in a housing (53) arranged around the axis (10) of rotation of the test device (1).

In one variant embodiment, the ends of the shaft are threaded in order to be fastened to the roller burnishing machine.

The test device (1) comprises rolling tracks (22) for rollers that are formed symmetrically with respect to the axis (10) of rotation of the test device (1). These rolling tracks (22) for rollers bear on the rollers (2) of the roller burnishing machine. The rolling tracks (22) for rollers (2) have given positions corresponding to the positions of the connection fillets formed on a crankshaft, in the roller burnishing machine, these positions being located relative to a plane perpendicular to the axis (10) of rotation of the test device (1). Taking a section along a plane passing through the axis (10) of rotation of the test device (1), the rolling tracks (22) for rollers (2) comprise a rounded profile to accommodate the rollers (2). The rounded profile of the rolling tracks (22) for rollers (2) can be seen particularly in each of FIGS. 1, 2 and 3. The material from which are made the rolling rings (20, 21) on which the rolling tracks (22) for rollers (2) are formed is identical in hardness to the material used to make the bearing wheels (3) of the roller burnishing machine. The diameter (D22) of the rolling tracks (22) for rollers (2) is chosen to be identical to the diameter of the cylindrical journal machined in the machine. The advantage over using a crankshaft to carry out a test on the rollers (2) is that the rolling tracks (22) for rollers according to the invention are not intended to be deformed by the rollers (2). Since the rollers (2) are exposed to a pressure which is similar to the pressure under machining conditions, the wear on the rollers (2) or on the bearing wheel (3) will be identical. A rolling track (22) for rollers will allow a complete wear test on at least one set of rollers (2) associated with a bearing wheel (3). In one test example, the roller burnishing machine drives the test device (1) according to the invention until a roller (2) or the bearing wheel (3) or the rolling ring (20) for the rollers breaks. The rolling rings (20, 40) can be easily disassembled and are, for example, replaced prior to the start of a test.

The test device (1) according to the invention comprises rolling tracks (42) for the support wheels (4). These rolling tracks (42) bear on the support wheels (4) of the roller burnishing machine. The rolling tracks (42) for the support wheels (4) have given positions corresponding to the positions of the cylindrical journals of the crankshaft which is machined in the rolling burnishing machine, these positions being located relative to a plane perpendicular to the axis (10) of rotation of the test device (1). The rolling tracks (42) for the support wheels (4) have a cylindrical shape whose axis of symmetry corresponds to the axis (10) of rotation of the test device (1). The profile of the rolling tracks (42) for the support wheels (4) in a section along a plane passing through the axis (10) of rotation of the device (1) is therefore a straight profile. This profile can be seen in particular in each of FIGS. 1, 2 and 3.

The test device (1) according to the present invention has means by which it can be fastened and driven by the roller burnishing machine that are identical to those of a crankshaft or that can be adapted to any type of roller burnishing machine. Furthermore, the test device (1) comprises rolling tracks (22, 42) positioned facing the roller burnishing tools, thus enabling the test device (1) according to the invention to be positioned in any type of roller burnishing machine in order to test the machine. Roller burnishing tools and machines are, for example, described in the documents which follow:

- US patent application 2002/0020202 describes, for example, a number of roller burnishing tools associated with cages which hold the rollers in a floating arrangement;
- U.S. Pat. No. 6,253,590 describes, for example, various embodiments of a roller burnishing tool comprising an upper part which supports the rollers in a cage and a lower part which comprises two support wheels for the cylindrical journal to be machined;
- patent application WO 2005/063438 describes, for example, a roller burnishing machine comprising two arms arranged one on each side of the crankshaft journal and an axial guide wheel for preventing a collision between the roller burnishing tools and elements of the crankshaft.

The use of the test device (1) according to the invention therefore makes it possible to carry out tests of many configurations, independently of the production line. The test configurations are not fixed. Carrying out many and varied tests is thus facilitated. Modifications for the purpose of improving the test tools are therefore facilitated. Improving the test tools concerns, for example, the guarantee of a more stable and longer service life of the roller burnishing tools. The test device (1) according to the invention, the structure of which will be detailed below, can be achieved using simple and inexpensive elements and, what is more, the test device (1) is manufactured and then mounted in a roller burnishing machine independently of the crankshaft manufacturing line. The tests are, for example, carried out on an auxiliary machine outside of the crankshaft production line. By virtue of the test device according to the invention, no crankshaft is required for example to test the service life or the wear rate of the roller burnishing tools. Furthermore, a complete test requires only one test device (1) according to the invention. Lubrication takes place in the same way as for the roller burnishing of a crankshaft. Since the dimensions of the test device (1) according to the invention are close to those of a crankshaft, the conditions for the tests are identical to the conditions under which the roller burnishing of a crankshaft is performed.

An embodiment of the test device (1) represented in FIG. 1 will now be described. With no limitation being implied, the test device (1) is adapted to a tool for roller burnishing a crankshaft comprising one or more cylindrical journals, for which crankshaft the tools for roller burnishing a cylindrical journal are tested simultaneously or successively.

A main shaft (6), the axis of revolution of which is identical to the axis (10) of rotation of the test device (1), is extended by two threaded ends (61) or is coupled to add-on parts comprising threaded ends. The main shaft has a diameter (D1) which is larger than the diameter (D2) of its ends (61). The diameter of the threaded portions is adapted to retaining nuts (7, 8, 9).

Without any limitation being implied, a collar (62) or a shoulder is arranged on the main shaft (6). Rolling rings (20, 40) are arranged on the main shaft (6). Without any limitation being implied, the rings (20, 40) are mounted with clamping on the main shaft (6). Without any limitation being implied, the rolling rings (20, 40) bear against the shoulder (62). The shoulder (62) makes it possible for the rolling rings (20, 40) to bear axially. The rolling elements (20, 40) are thus secured to the main shaft (6). Without any limitation being implied, the shoulder is formed at the end of the shaft or by the collar.

Without any limitation being implied, a nut (7) clamps the rolling rings (20, 40) on one side of the main shaft (6) and a double nut (8, 9) clamps the rolling rings (20, 40) on the other side of the shaft (6).

As represented in FIG. 1, the rolling track (22) for rollers (2) is formed with a diameter (D22) which is larger than the diameter (D42) of the rolling track (42) for the support wheels (4). The rolling rings (20) for the rollers (2) are formed, without any limitation being implied, symmetrically in order to facilitate their manufacture. Thus, this rolling ring (20) serves equally for a roller situated on the right and for a roller situated on the left, or even for two rollers.

One embodiment makes provision to use parts which exist already. Thus, the rolling rings (20) for the rollers (2) are formed by bearing wheels (3) of the roller burnishing machine, and the rolling rings (40) for the support wheels (4) are formed by spacers whose external diameter is smaller than or equal to the lateral external diameter of the bearing wheels (3). This embodiment has the advantage of using parts which exist already, which means that the test device (1) according to the invention can be produced immediately without requiring the machining of new parts, with the exception of the main shaft (6). In this embodiment, the rolling ring (20) for the rollers (2), which is a bearing wheel, will therefore have a wear rate which is virtually identical to that of the bearing wheel (3) of the roller burnishing machine. A service life test on the roller burnishing tools ends, for example, with the flaking of a roller (2) or a bearing wheel (3). Furthermore, this embodiment in which bearing wheels (3) are used as rolling elements for the rollers (2) ensures compatibility with the roller burnishing machine as regards the hardness and size of the rolling elements (20).

Figure 2:
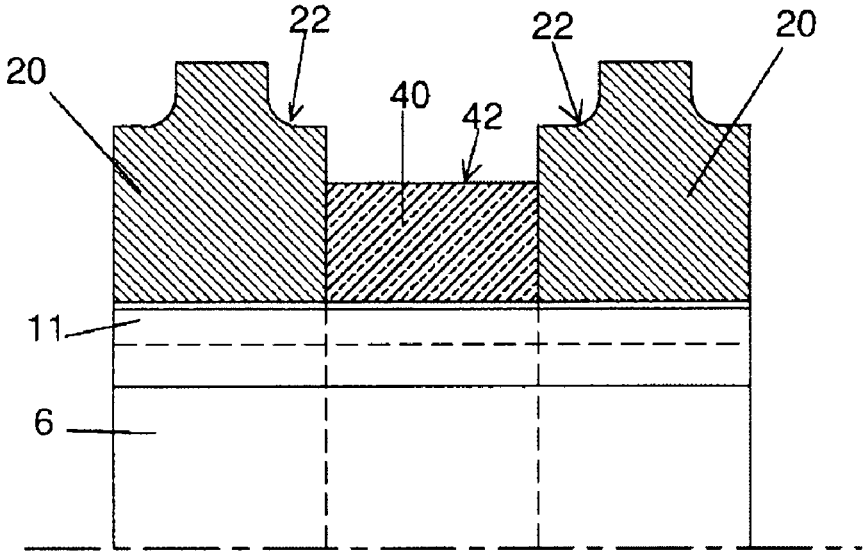
FIG. 2 represents a partial sectional view of an example of rolling rings according to the invention.

In one variant embodiment, as represented in FIG. 2, the rolling rings (20, 40) are held rotationally secured to the main shaft (6) by a key (11). Without any limitation being implied, the main shaft (6) is associated with one or more keys (11). The keys are used, without any limitation being implied, for a shaft which supports a large number of rolling devices.

Figure 3:
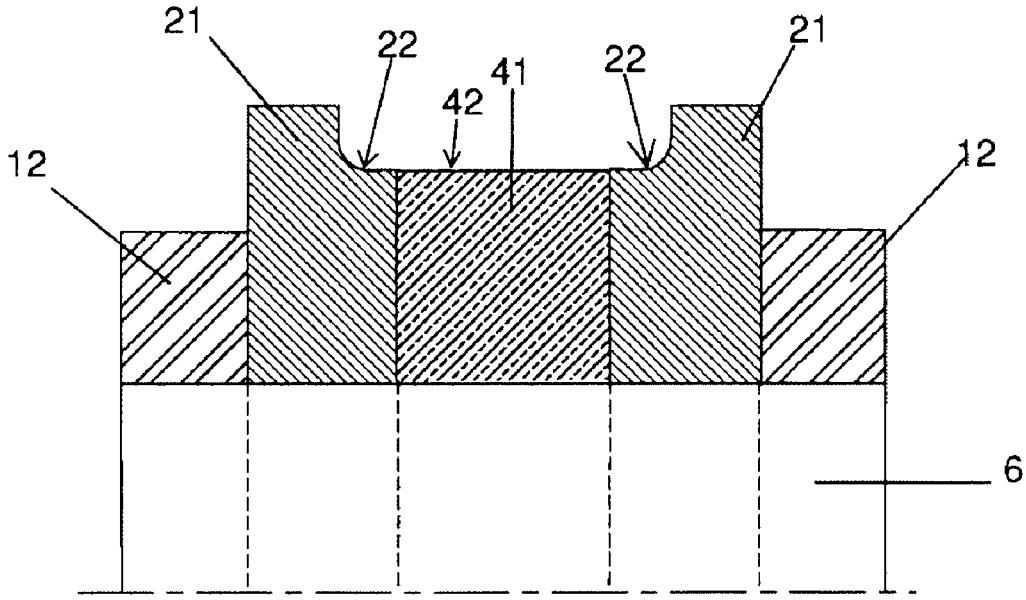
FIG. 3 represents a partial sectional view of an example of rolling rings according to the invention.

In one variant embodiment, as represented in FIG. 3, the rolling rings (21) for the rollers (2) have only one rolling track for rollers (2). A positioning spacer (12) is combined with the rolling rings (41, 21) in order to adjust the position of the rolling tracks (22, 42).

In one variant embodiment, as represented in FIG. 3, the rolling track (42) for the support wheels (4) is situated at the same height as the bottom part of the rolling track (22) for the rollers (2). The rolling ring (21) comprises a diameter (D22) which is identical to the diameter (D42) of the rolling ring (41) for the support wheels (4).

The test device (1), represented in FIG. 1, is adapted to the roller burnishing machine and makes it possible to simultaneously test the roller burnishing of a plurality of cylindrical journals, but the test device (1) according to the invention is also adapted to testing the roller burnishing tools for a single cylindrical journal of a crankshaft.

It should be obvious to persons skilled in the art that the present invention allows embodiments in many other specific forms without departing from the field of application of the invention as claimed. Therefore, the present embodiments are intended to be considered by way of illustration, but may be modified within the field defined by the scope of the appended claims, and the invention is not intended to be limited to the details given above.

The invention claimed is:

1. A test device for testing a machine for roller burnishing at least one cylindrical journal, the machine includes at least one roller configured to roll on a region of the cylindrical journal that is to be roller burnished, a bearing wheel exerting a pressure on the roller, and two support wheels configured to support the cylindrical journal on an opposite side to the roller, the test device comprising:

a main shaft including an axis of rotation and a first end that includes a threaded housing to receive a threaded rod of a drive device to rotate the test device about the axis of rotation;

a first rolling ring secured to a central portion of the main shaft, the first rolling ring including a rolling track for the roller of the roller burnishing machine, the rolling track having symmetry of revolution about the axis of rotation of the main shaft, with a profile including a rounded portion; and a cylindrical rolling track to contact the support wheels of the roller burnishing machine.

2. The test device as claimed in claim 1, further comprising:

second rolling rings for the support wheels that each form a cylindrical rolling track for a pair of the support wheels, the second rolling rings being rotationally secured to the central portion of the main shaft.

3. The test device as claimed in claim 2, wherein the main shaft comprises a shoulder for positioning a rolling ring of the first rolling ring or the second rolling rings which abuts the shoulder.

4. The test device as claimed in claim 2, wherein the first rolling ring and the second rolling rings each comprise an axial groove in which a key extending from the main shaft is positioned to provide reinforced retention in terms of rotation.

5. The test device as claimed in claim 1, wherein the first rolling ring is formed of a material which is identical in hardness to that of the bearing wheel of the roller burnishing machine.

6. A test device for testing a machine for roller burnishing at least one cylindrical journal, the machine includes at least one roller configured to roll on a region of the cylindrical journal that is to be roller burnished, a bearing wheel exerting a pressure on the roller, and two support wheels configured to support the cylindrical journal on an opposite side to the roller, the test device comprising:

retaining and drive means in the roller burnishing machine, which moves the test device rotationally about an axis of rotation;

a rolling track for rollers that is associated with the roller and that comes into contact with the roller, the rolling track for rollers having symmetry of revolution about the axis of rotation of the device, with a profile including a rounded portion; and a main shaft supporting rolling rings for the rollers that each comprise at least one rolling track for rollers, the main shaft supporting rolling rings for the support wheels that each form a cylindrical rolling track for a pair of support wheels, the rolling rings being rotationally secured to the main shaft, wherein the roller burnishing machine is configured for the roller burnishing of a crankshaft including a given number of cylindrical journals, and wherein the retaining and drive means in the roller burnishing machine comprises:

a bore arranged at a first end of the main shaft symmetrically to the axis of rotation of the test device and configured to receive a first drive center;

a threaded hole arranged at a second end of the main shaft arranged symmetrically about the axis of rotation of the test device and configured to receive a threaded rod of a drive device; and the drive device comprising, on a side directed away from the threaded rod, a bore which is coaxial with the axis of rotation of the test device and configured to receive a second drive center.

7. The test device as claimed in claim 1, wherein a second end of the main shaft includes a bore to receive a support center of the drive device to support the test device.

8. The test device as claimed in claim 1, wherein a diameter of the central portion of the main shaft is larger than a diameter of the first end of the main shaft.

9. The test device as claimed in claim 2, wherein a diameter of the rolling track of the first rolling ring is equal to a diameter of one of the second rolling rings.

* * * * *